US010054869B2

(12) United States Patent
Ishida

(10) Patent No.: US 10,054,869 B2
(45) Date of Patent: Aug. 21, 2018

(54) IMAGE FORMING APPARATUS FOR DETECTING CRACK GENERATED IN CHARGING MEMBER, METHOD FOR CONTROLLING THE IMAGE FORMING APPARATUS, AND CONTROL PROGRAM USED IN THE IMAGE FORMING APPARATUS

(71) Applicant: Konica Minolta, Inc., Chiyoda-ku, Tokyo (JP)

(72) Inventor: Hirofumi Ishida, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/459,794

(22) Filed: Mar. 15, 2017

(65) Prior Publication Data

US 2017/0269500 A1 Sep. 21, 2017

(30) Foreign Application Priority Data

Mar. 15, 2016 (JP) ..... 2016-051050

(51) Int. Cl.
*G03G 15/02* (2006.01)
*G03G 15/00* (2006.01)

(52) U.S. Cl.
CPC ..... *G03G 15/0266* (2013.01); *G03G 15/0216* (2013.01); *G03G 15/553* (2013.01)

(58) Field of Classification Search
CPC ..... G03G 15/0216; G03G 15/0233; G03G 15/0258; G03G 15/0266
See application file for complete search history.

(56) References Cited

U.S. PATENT DOCUMENTS 7,532,831 B2 * 5/2009 Kitano ..... G03G 15/0266 399/44
7,630,659 B2 * 12/2009 Uchitani ..... G03G 15/5037 399/44
2014/0064751 A1 * 3/2014 Kuroiwa ..... G03G 15/55 399/31

FOREIGN PATENT DOCUMENTS

JP 11352754 A 12/1999

* cited by examiner

*Primary Examiner* — Gregory H Curran
(74) *Attorney, Agent, or Firm* — Cantor Colburn LLP

(57) ABSTRACT

In order to achieve at least one of the above-described objects, an image forming apparatus reflecting an aspect of the present invention includes: an image carrier configured to carry and transport a latent image; a charging member configured to be rotatable and disposed in contact with a surface of the image carrier; an acquisition device configured to acquire an electrical characteristic of the charging member; and a processor configured to calculate a range of fluctuation of the electrical characteristic associated with rotation of the charging member.

23 Claims, 14 Drawing Sheets

100

GENERATION OF CRACK

GROWTH OF CRACK

100A

IMAGE FORMING APPARATUS FOR DETECTING CRACK GENERATED IN CHARGING MEMBER, METHOD FOR CONTROLLING THE IMAGE FORMING APPARATUS, AND CONTROL PROGRAM USED IN THE IMAGE FORMING APPARATUS

CROSS REFERENCE TO RELATED APPLICATIONS

This application is based on Japanese Patent Application No. 2016-051050 filed with the Japan Patent Office on Mar. 15, 2016, the entire content of which is hereby incorporated by reference.

BACKGROUND OF THE INVENTION

Field of the Invention

The present disclosure relates to an image forming apparatus, and more specifically relates to an image forming apparatus based on electrophotography.

Description of the Related Art

In an image forming apparatus based on electrophotography, means for electrically charging a photoconductor is known to include a non-contact charging system implemented by means of corona discharge or the like and a contact charging system implemented by means of a charging roller or the like. Recently, for the sake of energy saving or the like, the contact charging system has more widely been used relative to the non-contact charging system.

On the surface of the charging roller used for the contact charging system, a thin protective layer (surface layer) is mounted for the purpose of reducing adhesion of dirt or the like. The charging roller is generally positioned in contact with the photoconductor and configured to rotate following rotation of the photoconductor. Therefore, a stress applied from the photoconductor to the surface layer of the charging roller is caused to vary by repeated contact with and separation from the photoconductor. Due to the influence of this stress variation, the surface layer of the charging roller is gradually degraded to be eventually broken, resulting in generation of cracks.

As to the technique for detecting the surface state of the charging roller, Japanese Laid-Open Patent Publication No. 11-352754 discloses that light is applied to the charging roller and the light reflected from the charging roller is received to detect the surface property (surface roughness) of the charging roller. The technique disclosed in the above-referenced document changes AC current applied from a charging bias source to the charging roller, depending on information about the surface property of the charging roller, to thereby apply appropriate AC current to the charging roller, regardless of the state of the surface property of the charging roller.

SUMMARY OF THE INVENTION

When a crack is generated in the surface layer of the charging roller, the potential to which the photoconductor is charged is nonuniform. When the crack is small, human eyes cannot recognize the non-uniformity of the toner density resulting from the crack. However, once a crack is generated, stress is concentrated on the surface layer in which the top of the crack is located. Thus, the crack has a characteristic that it grows exponentially. Therefore, when the crack becomes larger than a certain size, image non-uniformity which can be recognized even by human eyes occurs. It is accordingly desirable for the image forming apparatus based on electrophotography to monitor the state of the charging roller.

The technique disclosed in the above-referenced document, however, optically detects the surface roughness of the charging roller and performs control so as to stabilize the potential to which the photoconductor is charged. Thus, the above-referenced document does not mention the crack at all. Even when the technique disclosed in the document is used for detecting a crack of the charging roller, the technique essentially uses optical detection. It is therefore impossible for this technique to detect a crack generated inside the surface layer of the charging roller rather than generated at the surface of the charging roller.

The present disclosure is given to provide a solution to the problem as described above. In an aspect, an object is to provide an image forming apparatus capable of detecting a crack generated in a charging roller with a higher accuracy as compared with the conventional apparatus, and a control program to be used in the image forming apparatus.

An image forming apparatus includes: an image carrier configured to carry and transport a latent image; a charging member configured to be rotatable and disposed in contact with a surface of the image carrier; an acquisition device configured to acquire an electrical characteristic of the charging member; and a processor configured to calculate a range of fluctuation of the electrical characteristic associated with rotation of the charging member.

In an aspect, the processor is configured to acquire the electrical characteristic over a time interval taken for the charging member to make at least one rotation, and calculate the range of fluctuation of the electrical characteristic in the time interval.

In an aspect, the processor is configured to perform a predetermined operation based on the calculated range of fluctuation.

In an aspect, the processor is configured to perform the predetermined operation when the range of fluctuation exceeds a predetermined threshold value.

In an aspect, the predetermined operation includes an operation of increasing a charging bias voltage to be applied to the image carrier through the charging member in printing, as the range of fluctuation increases.

In an aspect, the predetermined operation includes an operation of predicting a lifetime of at least one of the charging member and a unit including the charging member, based on information about history of the range of fluctuation which is associated with at least one of:

information about a cumulative number of revolutions of the charging member;

information about a cumulative distance of travel of the charging member;

information about a cumulative rotation period of the charging member; and information about a cumulative number of printed sheets of paper obtained by using the charging member.

In an aspect, the image forming apparatus further includes an interface configured to allow communication with an external device. The predetermined operation includes an operation of informing the external device, through the interface, of the predicted lifetime.

In an aspect, the image forming apparatus further includes an interface configured to allow communication with an external device. The predetermined operation includes an operation of informing the external device, through the interface, of reaching the lifetime, when a predetermined condition based on the information about history of the range of fluctuation is satisfied.

In an aspect, the image forming apparatus further includes a display configured to present information to a user. The predetermined operation includes an operation of indicating the predicted lifetime on the display.

In an aspect, the processor is configured to perform control to make a surface speed of the charging member slower than the surface speed of the charging member during printing, over a time interval in which the acquisition device acquires the electrical characteristic.

In an aspect, the image forming apparatus further includes a sensor configured to measure information about at least one of temperature and humidity. The processor is configured to calculate the range of fluctuation converted in accordance with a result of measurement by the sensor.

In an aspect, the processor is configured to acquire the electrical characteristic over a time interval taken for the charging member to make at least two rotations, and calculate the range of fluctuation based on a peak of the electrical characteristic detected in a period corresponding to an external diameter of the charging member.

In an aspect, the electrical characteristic includes a value of current flowing in the charging member when a predetermined voltage is applied to the charging member.

In an aspect, the electrical characteristic includes a value of voltage generated at the charging member when a predetermined current is applied to the charging member.

In an aspect, the processor is configured to calculate the range of fluctuation at a predetermined timing.

In accordance with another aspect, there is provided a method for controlling an image forming apparatus including a charging member disposed in contact with a surface of an image carrier and configured to be rotatable. The control method includes: acquiring an electrical characteristic of the charging member over a predetermined time interval in which the charging member rotates; and calculating a range of fluctuation of the acquired electrical characteristic.

In accordance with still another aspect, there is provided a computer-readable recording medium storing a control program for an image forming apparatus including a charging member disposed in contact with a surface of an image carrier and configured to be rotatable. The recording medium stores the program causing a computer to execute a process including: acquiring an electrical characteristic of the charging member over a predetermined time interval in which the charging member rotates; and calculating a range of fluctuation of the acquired electrical characteristic.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1B:
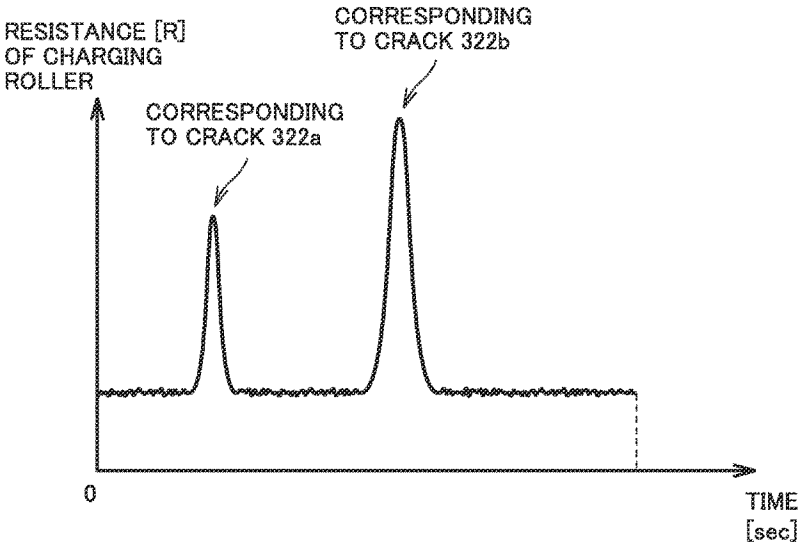
FIG. 1B is a diagram illustrating fluctuation of a resistance value of a charging roller 320.

Embodiments of the present invention will hereinafter be described in detail with reference to the drawings. In the drawings, the same or corresponding parts are denoted by the same reference characters, and a description thereof will not be repeated.

A. Overview

Figure 1A:
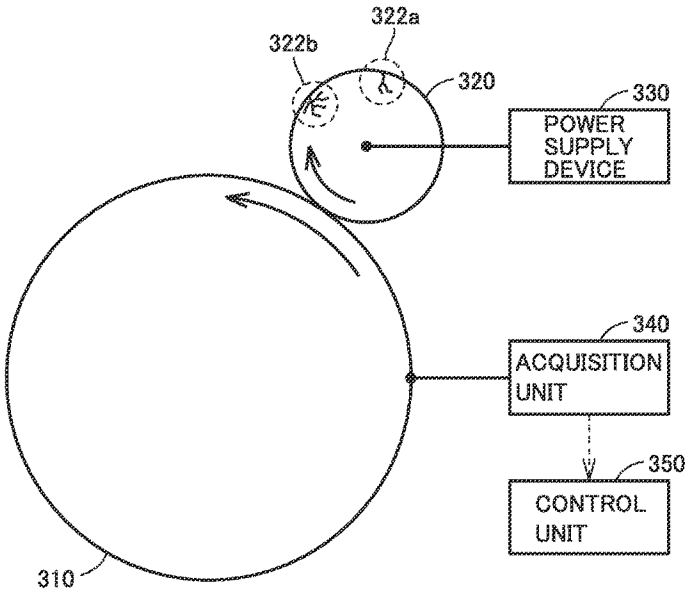
FIG. 1A is a diagram illustrating an example configuration of a part of an image forming apparatus in accordance with an embodiment.

FIG. 1A is a diagram illustrating an example configuration of a part of an image forming apparatus in accordance with an embodiment. Referring to FIG. 1A, the image forming apparatus in accordance with the embodiment is based on electrophotography and includes a photoconductor 310, a charging roller 320, a power supply device 330, an acquisition unit 340, and a control unit 350.

Charging roller 320 is positioned in contact with photoconductor 310, and rotates following rotation of photoconductor 310. Power supply device 330 applies a predetermined voltage to a metal shaft contained in charging roller 320 and extending in the longitudinal direction of the charging roller. Thus, charging roller 320 charges the surface of photoconductor 310 to a desired potential.

On the surface of charging roller 320, a thin protective layer (surface layer) is formed. In the example shown in FIG. 1A, a crack 322*a* and a crack 322*b* are generated in the surface layer of the charging roller. Moreover, crack 322*b* is larger than crack 322*a* (larger in the gap volume).

As described above, due to the cracks generated in the charging roller, an image defect may occur. It is therefore desirable for the image forming apparatus to detect the state of these cracks. Regarding this respect, the applicant of the present application has found that fluctuation of an electrical characteristic of the charging roller can be calculated to detect the state of a crack generated in the charging roller.

Acquisition unit 340 measures an electrical characteristic of charging roller 320 during rotation of charging roller 320, and outputs the result of the measurement to control unit 350. By way of example, acquisition unit 340 is connected to photoconductor 310 and measures the value of current which is obtained when a constant voltage is applied to the metal shaft in charging roller 320 from power supply device 330. Control unit 350 calculates the resistance value of charging roller 320 from the value of current which is input from acquisition unit 340.

FIG. 1B is a diagram illustrating fluctuation of a resistance value of charging roller 320. Referring to FIG. 1B, it is seen from FIG. 1B that the resistance value of charging roller 320 increases at respective timings when cracks 322*a* and 322*b* pass by the measurement position of acquisition unit 340. Moreover, the fluctuation of the resistance value of charging roller 320 corresponding to crack 322*b* is larger than the fluctuation of the resistance value corresponding to crack 322*a*. This is because of the fact that crack 322*b* is larger than crack 322*a*.

Control unit 350 can make use of these characteristics to calculate the range of fluctuation of the electrical characteristic of charging roller 320 and determine that the crack grows with increase of the range of fluctuation.

According to the foregoing, the image forming apparatus in accordance with the embodiment is capable of detecting a crack generated in the charging roller based on the range of fluctuation of the electrical characteristic of the charging roller. Moreover, this detection method makes use of the electrical characteristic of the charging roller and is therefore capable of accurately detecting a crack generated inside the surface layer of the charging roller which is difficult to optically detect. Further, by this the detection method, not only a crack generated in the charging roller but also the size of the crack can be detected. The following are details of the configuration and control of the image forming apparatus.

B. First Embodiment—Detection of State of Crack Based on Range of Fluctuation of Electrical Characteristic b1. Image Forming Apparatus 100

Figure 2:
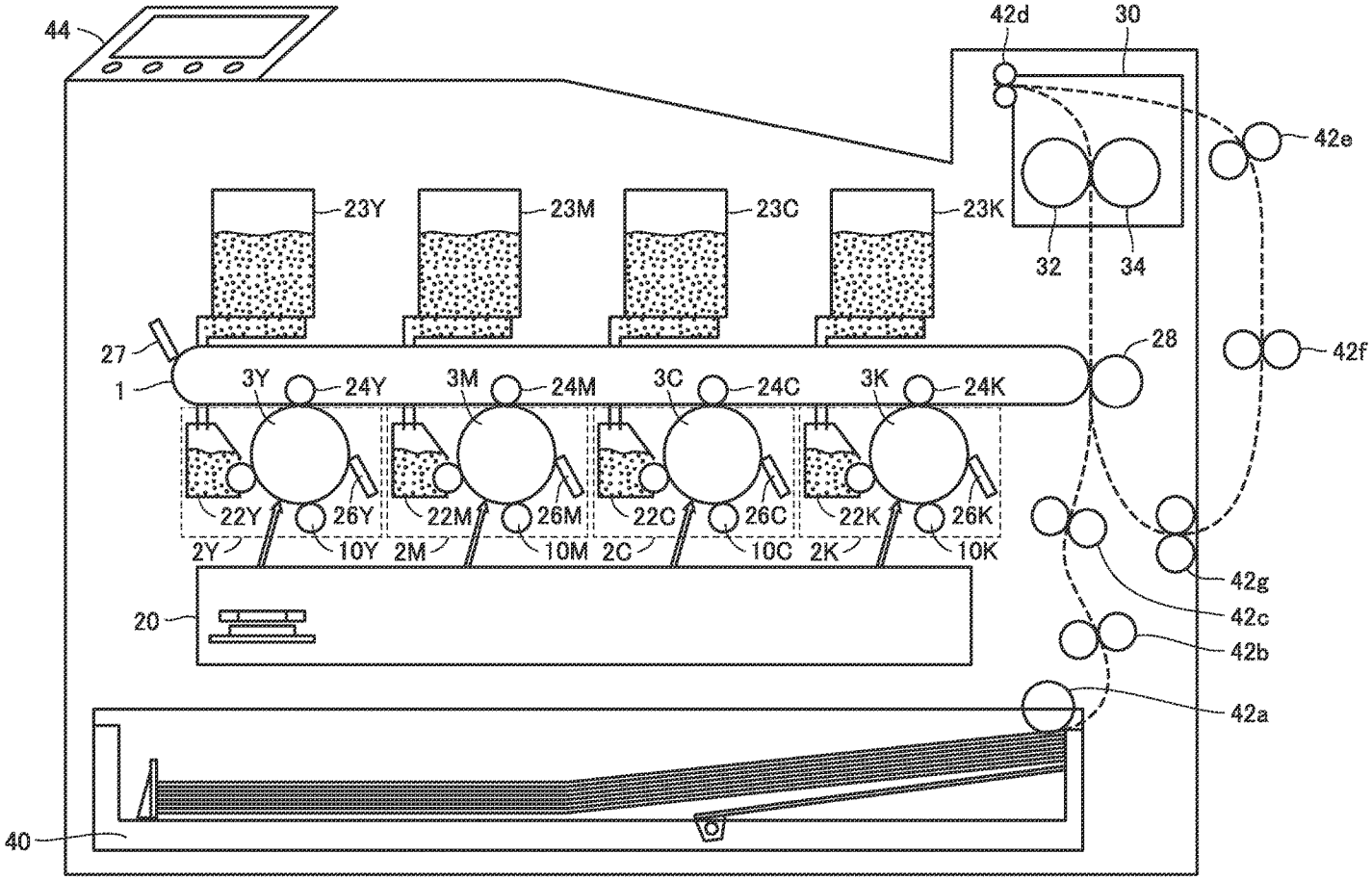
FIG. 2 is a diagram illustrating an example configuration of an image forming apparatus in accordance with a first embodiment.

FIG. 2 is a diagram illustrating an example configuration of an image forming apparatus 100 in accordance with a first embodiment. Image forming apparatus 100 is an image forming apparatus based on electrophotography, such as laser printer and LED printer, and forms an image on a medium such as a sheet of paper, based on an input image signal. As shown in FIG. 2, image forming apparatus 100 includes an intermediate transfer belt 1 as a belt member at a substantially central portion in the image forming apparatus. Under a lower horizontal portion of intermediate transfer belt 1, four imaging units 2Y, 2M, 2C, 2K corresponding respectively to the colors: yellow (Y), magenta (M), cyan (C), black (K) are arranged along intermediate transfer belt 1, and these units have photoconductors 3Y, 3M, 3C, 3K, respectively. Each of imaging units 2Y, 2M, 2C, 2K in image forming apparatus 100 is configured to be replaceable. Photoconductors 3Y, 3M, 3C, 3K for carrying and transporting a latent image each develop a toner image on a photoconductor film formed on the outer periphery of the photoconductor. The toner image is to be transferred to a medium such as a sheet of paper.

Around photoconductors 3Y, 3M, 3C, 3K, the following components are arranged in order in the rotational direction of the photoconductors, and the components are: charging rollers 10Y, 10M, 10C, 10K, a laser unit 20, developing devices 22Y, 22M, 22C, 22K, primary transfer rollers 24Y, 24M, 24C, 24K, which face respective photoconductors 3Y, 3M, 3C, 3K with intermediate transfer belt 1 interposed between the photoconductor and the primary transfer roller, and cleaning blades 26Y, 26M, 26C, 26K. To developing devices 22Y, 22M, 22C, 22K, toner bottles 23Y, 23M, 23C, 23K are connected, respectively. For intermediate transfer belt 1, a cleaning device 27 is disposed in contact with the intermediate transfer belt.

For intermediate transfer belt 1, a secondary transfer roller 28 is pressed against the intermediate transfer belt. In this region, secondary transfer is performed. A fixing device 30 including a fixing roller 32 and a pressure roller 34 is arranged downstream of a transport path located behind the secondary transfer region.

In a lower portion of image forming apparatus 100, a paper feed cassette 40 is removably disposed. Sheets of paper stacked and contained in paper feed cassette 40 are fed one by one from the top sheet to the transport path by rotation of a transport roller 42*a*. On the transport path, transport roller pairs 42*b*, 42*c*, 42*d*, 42*e*, 42*f*, 42*g* are arranged. Moreover, in an upper portion of image forming apparatus 100, a display unit 44 is disposed. Display unit 44 is a touch panel receiving inputs from a user.

While image forming apparatus 100 in the present embodiment uses the tandem intermediate transfer system by way of example, the image forming apparatus is not limited to this. Specifically, the image forming apparatus may be an image forming apparatus which is based on electrophotography and uses the cycle system, or an image forming apparatus which uses a direct transfer system by which toner is directly transferred from a developing device to a printing medium. Alternatively, the image forming apparatus may be a multifunction device incorporating functions such as copier, printer, and facsimile functions.

b2. General Operation of Image Forming Apparatus 100

Next, a general operation of image forming apparatus 100 configured in the above-described manner will be described. Upon input of an image signal from an external device (such as personal computer for example) to image forming apparatus 100, image forming apparatus 100 generates a digital image signal by color conversion of the input image signal to yellow, magenta, cyan, black. Based on the generated digital image signal, image forming apparatus 100 causes laser unit 20 to emit light so as to perform exposure.

Accordingly, a latent image formed on each of photoconductors 3Y, 3M, 3C, 3K is developed by toner supplied from a corresponding one of developing devices 22Y, 22M, 22C, 22K to generate a toner image of each color. When the amount of toner in each of developing devices 22Y, 22M, 22C, 22K decreases, toner is supplied from corresponding toner bottles 23Y, 23M, 23C, 23K.

Toner images of respective colors are successively laid on one another on intermediate transfer belt 1 by the action of primary transfer rollers 24Y, 24M, 24C, 24K. Primary transfer is thus accomplished. After the primary transfer, toner remaining on each photoconductor 3Y, 3M, 3C, 3D is collected by corresponding cleaning blade 26Y, 26M, 26C, 26K.

The toner images thus formed on intermediate transfer belt 1 undergo secondary transfer all together onto a sheet of paper by the action of secondary transfer roller 28. Toner remaining on intermediate transfer belt 1 is collected by cleaning device 27.

The toner image which is secondary-transferred to the sheet of paper reaches fixing device 30. The toner image is fixed on the sheet of paper by the action of heated fixing roller 32 and pressure roller 24. The paper on which the toner image is fixed is discharged through transport roller pair 42*d* to a copy receiving tray.

When images are to be formed on both sides of a sheet of paper, transport roller pair 42*d* is rotated in the opposite direction after the sheet of paper has passed through fixing device 30, and the sheet of paper is transported again by transport roller pairs 42*e*, 42*f*, and 42*g* to the secondary transfer region. In this way, the above-described secondary transfer and fixing for the sheet of paper are performed. After this, the paper is discharged by transport roller pair 42*d* to the copy receiving tray.

b3. Control Unit 50

Figure 3:
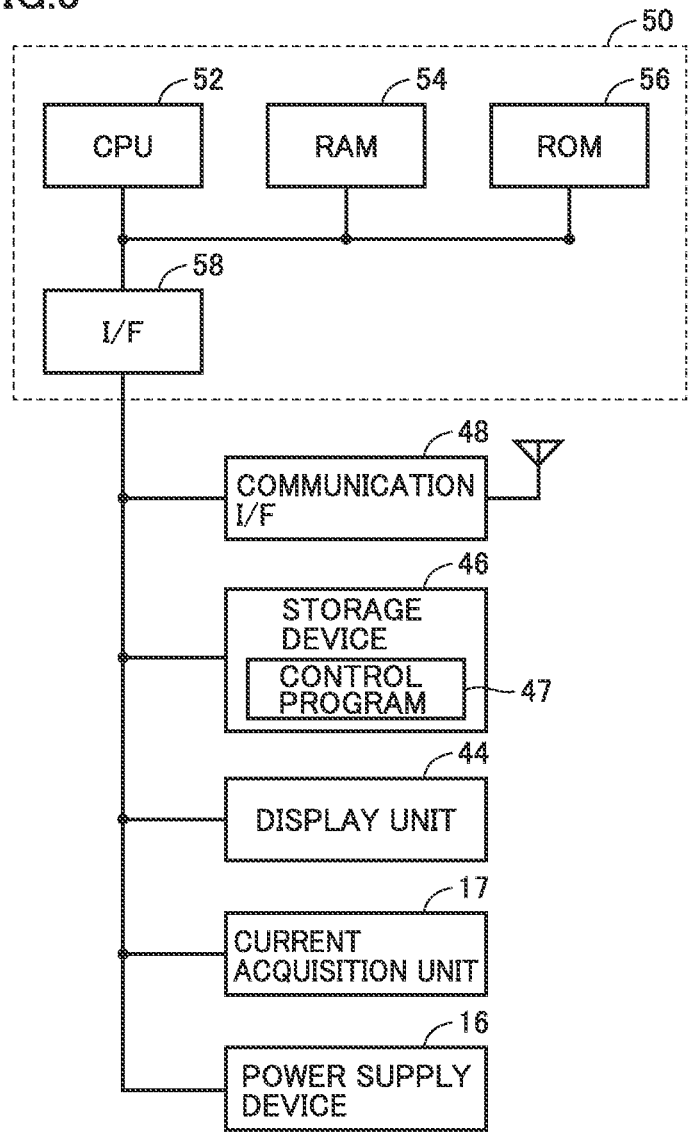
FIG. 3 is a diagram illustrating a control unit in accordance with the first embodiment.

FIG. 3 is a diagram illustrating control unit 50 in accordance with the first embodiment. Control unit 50 included in image forming apparatus 100 includes, as its main control elements, a CPU (Central Processing Unit) 52, a RAM (Random Access Memory) 54, a ROM (Read Only Memory) 56, and an interface (I/F) 58.

CPU 52 reads a control program 47 stored in a storage device 46, through interface 58, and executes this program to thereby effect the overall processing of image forming apparatus 100. CPU 52 may be any of microprocessor, FPGA (Field Programmable Gate Array), ASIC (Application Specific Integrated Circuit), DSP (Digital Signal Processor), and other circuits having a computing capability.

RAM 54 is typically DRAM (Dynamic Random Access Memory) or the like, and temporarily stores image data and data necessary for CPU 52 to execute a program. Thus, RAM 54 functions as a so-called working memory.

ROM 56 is typically flash memory or the like and stores a program to be executed by CPU 52 and information about various settings for operation of image forming apparatus 100.

Interface 58 is used as a medium for allowing control unit 50 to exchange signals with a power supply device 16 described later herein, a current acquisition unit 17 described later herein, display unit 44, storage device 46, and a communication interface 48.

b4. Charging Roller and its Peripheral Devices

Next, control for detecting a crack generated in charging rollers 10Y, 10M, 10C, 10K will be described. Since charging rollers 10Y, 10M, 10C, 10K have the same structure, the following is a description of detection of a crack in charging roller 10Y as a representative example of the charging rollers.

Figure 4:
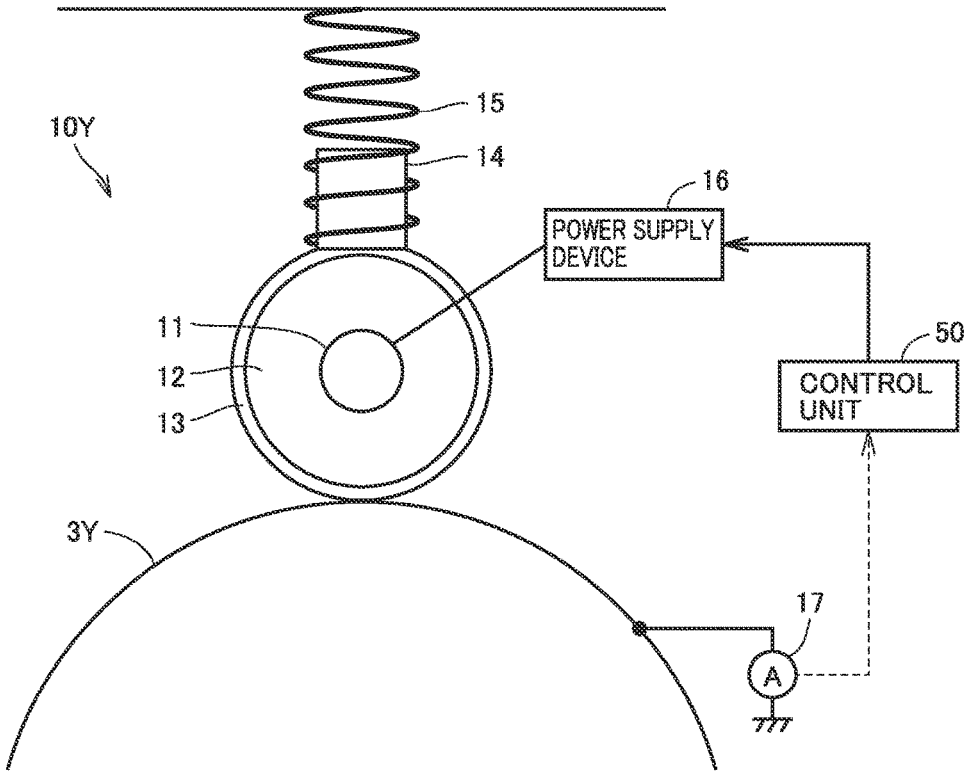
FIG. 4 is a diagram illustrating an example configuration of a charging roller and peripheral devices in accordance with the first embodiment.

FIG. 4 is a diagram illustrating an example configuration of charging roller 10Y and peripheral devices in accordance with the first embodiment. Referring to FIG. 4, charging roller 10Y includes a core 11, an elastic layer 12, and a protective layer 13. Core 11 is made from an electrically conductive material such as metal. Elastic layer 12 is made from an electrically conductive rubber or the like. Protective layer 13 is made from a relatively hard resin or the like. Elastic layer 12 is disposed on the outer peripheral surface of core 11, and protective layer 13 is disposed on the outer peripheral surface of elastic layer 12.

For protective layer 13, a material with a high hardness is used for the purpose of suppressing adhesion of dirt to the surface of charging roller 10Y, and protective layer 13 has a thickness of about 10 μm.

Charging roller 10Y has a guide member 14 which holds core 11, and one end of a spring 15 is connected to guide member 14. The other end of spring 15 is fixed to another member (wall or the like). Spring 15 performs a function of pressing charging roller 10Y against photoconductor 3Y.

One set of guide member 14 and spring 15 and another set of guide member 14 and spring 15 are arranged at two locations in total, namely at respective opposite ends, in the longitudinal direction, of charging roller 10Y, and evenly press charging roller 10Y against photoconductor 3Y. Charging roller 10Y is disposed in contact with photoconductor 3Y by the action of spring 15, and therefore rotates following rotation of photoconductor 3Y.

To core 11 of charging roller 10Y, power supply device 16 is electrically connected. When a charging bias voltage is applied from power supply device 16 to core 11, proximity discharge occurs in spaces which are opposite to each other with respect to the portion where protective layer 13 contacts photoconductor Y. Electrical charge is applied to the surface of photoconductor 3Y by this discharge and the surface is accordingly charged.

Protective layer 13 is pressed by spring 15 against photoconductor 3Y and accordingly stress is generated in protective layer 13. Charging roller 10Y rotates following rotation of photoconductor 3Y. Therefore, in a local region of protective layer 13, stress generated in this local region varies depending on whether protective layer 13 is in contact with photoconductor 3Y or not. As this stress variation is repeated, a crack is accordingly generated in protective layer 13.

When the pressing force applied by spring 15 from charging roller 10Y to photoconductor 3Y is large, an excessive force is exerted on protective layer 13, specifically on the surface where protective layer 13 contacts photoconductor 3Y. Then, a crack is likely to be generated in protective layer 13. Therefore, in order to prevent generation of a crack in protective layer 13, the pressing force of spring 15 may be reduced. However, if the pressing force of spring 15 is reduced, the state of contact between charging roller 10Y and photoconductor 3Y is instable and the proximity discharge is disturbed, resulting in failure in discharge. In view of this, the pressing force of spring 15 may be adjusted to suppress a crack generated in protective layer 13 to some extent. However, it is impossible to eliminate crack generation itself.

Figure 5A:
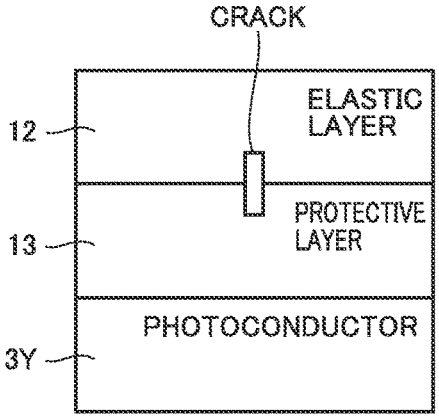
FIG. 5A is a diagram illustrating generation of a crack.
Figure 5B:
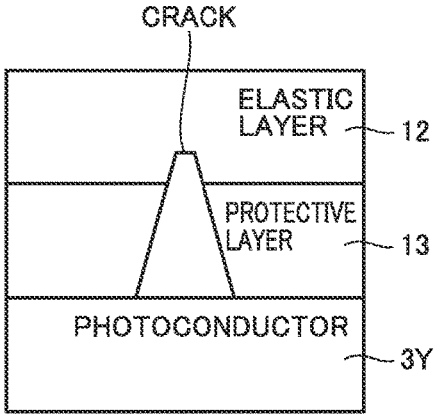
FIG. 5B is a diagram illustrating growth of a crack.

Next, referring to FIGS. 5A and 5B, generation and control of a crack will be described. FIG. 5A shows a state when a crack is generated in charging roller 10Y. FIG. 5B shows a state after the crack has grown.

As shown in FIG. 5A, a crack is likely to be generated in a joint area between elastic layer 12 and protective layer 13 of charging roller 10Y, because of difference in degree of shrinkage in the circumferential direction, between protective layer 13 and elastic layer 12. Since protective layer 13 is extremely thinner and has a smaller curvature relative to elastic layer 12, protective layer 13 is larger in degree of shrinkage than elastic layer 12. Therefore, distortion occurs at their surfaces joined to each other and a crack is likely to be generated.

A shearing force acts on a crack generated in the inside. The crack therefore grows exponentially, and eventually the surface of charging roller 10Y is broken. This state is the state shown in FIG. 5B. A crack generated at the surface of charging roller 10Y also grows with use.

In the state where a small crack is generated inside charging roller 10Y, an image defect due to the crack is less likely to occur. However, as the crack grows with use, an image defect due to the crack occurs. Image forming apparatus 100 detects generation of a crack as well as its growth in charging roller 10Y and accurately recognizes the state of charging roller 10Y.

b5. Detection of Crack Generated in Charging Roller

Referring again to FIG. 4, image forming apparatus 100 includes current acquisition unit 17 connected to photoconductor 3Y. Current acquisition unit 17 measures the value of current which is obtained when a constant voltage (200 V for example) is applied from power supply device 16 to core 11 while charging roller 10Y is driven to rotate following rotationally driven photoconductor 3Y, and outputs the result of measurement to control unit 50. Based on the value of current which is input from current acquisition unit 17, control unit 50 calculates the value of resistance as an electrical characteristic of charging roller 10Y. Namely, current acquisition unit 17 is a device for acquiring an electrical characteristic of charging roller 10Y.

Figure 6:
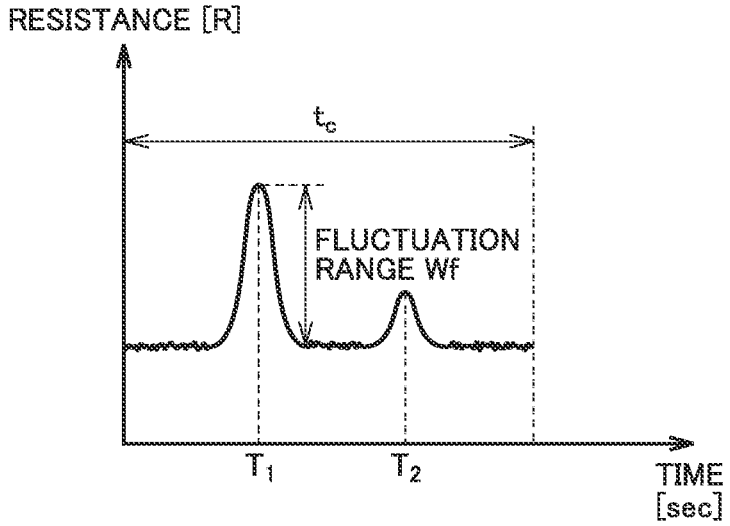
FIG. 6 is a diagram illustrating fluctuation of a resistance value of a charging roller in accordance with the first embodiment.

FIG. 6 is a diagram illustrating fluctuation of a resistance value of charging roller 10Y in accordance with the first embodiment. In the example shown in FIG. 6, current acquisition unit 17 acquires the value of current over period tc which is a time interval taken for charging roller 10Y to make at least one rotation. Based on the value of current which is input from current acquisition unit 17, control unit 50 acquires the resistance value in the period taken for charging roller 10Y to make one rotation (the resistance is hereinafter also referred to as "in-period resistance").

Referring to FIG. 6, the resistance value of charging roller 10Y has peaks at time T1 and T2. As illustrated in FIG. 1, in the case where a crack is generated in charging roller 10Y, the resistance value of charging roller 10Y rises at the timing when the crack passes by the measurement position of current acquisition unit 17, namely the timing when contact with photoconductor 3Y occurs. Therefore, at time T1 and T2, control unit 50 can determine that a crack has been generated in charging roller 10Y.

The resistance value of charging roller 10Y varies depending on the state of use (cumulative number of revolutions for example) and the like of charging roller 10Y. Therefore, in order to avoid an influence of the state of use, control unit 50 detects the state of a crack based on fluctuation range Wf determined by subtracting a minimum resistance value of the in-period resistance of charging roller 10Y from a maximum resistance value thereof.

Figure 7:
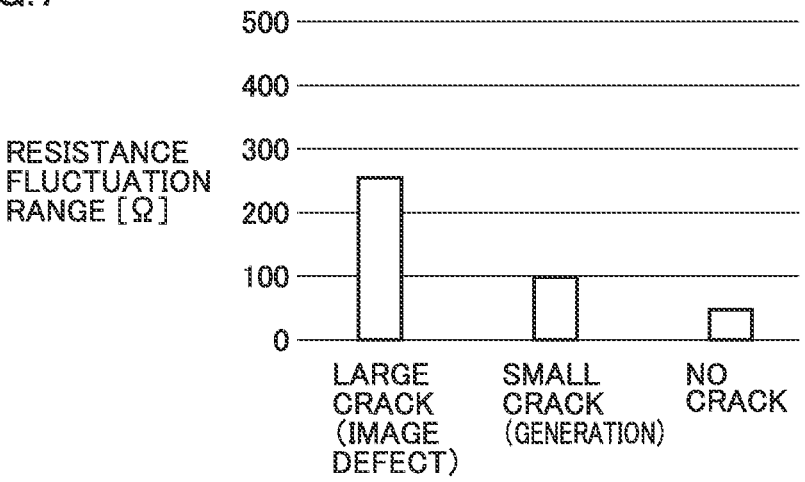
FIG. 7 is a diagram illustrating a relation between a fluctuation range and a state of a crack.

FIG. 7 is a diagram illustrating a relation between fluctuation range Wf and the state of a crack. Referring to FIG. 7, even when no crack is generated in charging roller 10Y, some fluctuation range Wf (50Ω for example) is observed. This is because of the fact that the resistance is measured while photoconductor 3Y and charging roller 10Y are driven and because of the non-uniformity of the surface state of photoconductor 3Y and charging roller 10Y, or the like.

When a small crack is generated between elastic layer 12 and protective layer 13 of charging roller 10Y with use, fluctuation range Wf of approximately 100Ω is observed. With further use, the generated crack grows to become large and, when fluctuation range Wf becomes approximately 250Ω, an image defect occurs.

This image defect is suppressed by increasing the charging bias voltage applied from power supply device 16 to charging roller 10Y relative to the charging bias voltage during initial printing. However, increase of the charging bias voltage promotes attrition of the photoconductor and thereby shortens the lifetime of imaging unit 2Y. Therefore, control unit 50 applies a charging bias voltage depending on fluctuation range Wf. More specifically, when the calculated fluctuation range Wf exceeds 250Ω, control unit 50 increases the charging bias voltage as fluctuation range Wf increases. In this way, image forming apparatus 100 in accordance with the first embodiment can prevent an image defect due to a crack in the charging roller and extend the lifetime of the imaging unit.

b6. Detection of Crack and Flow of Control

Figure 8:
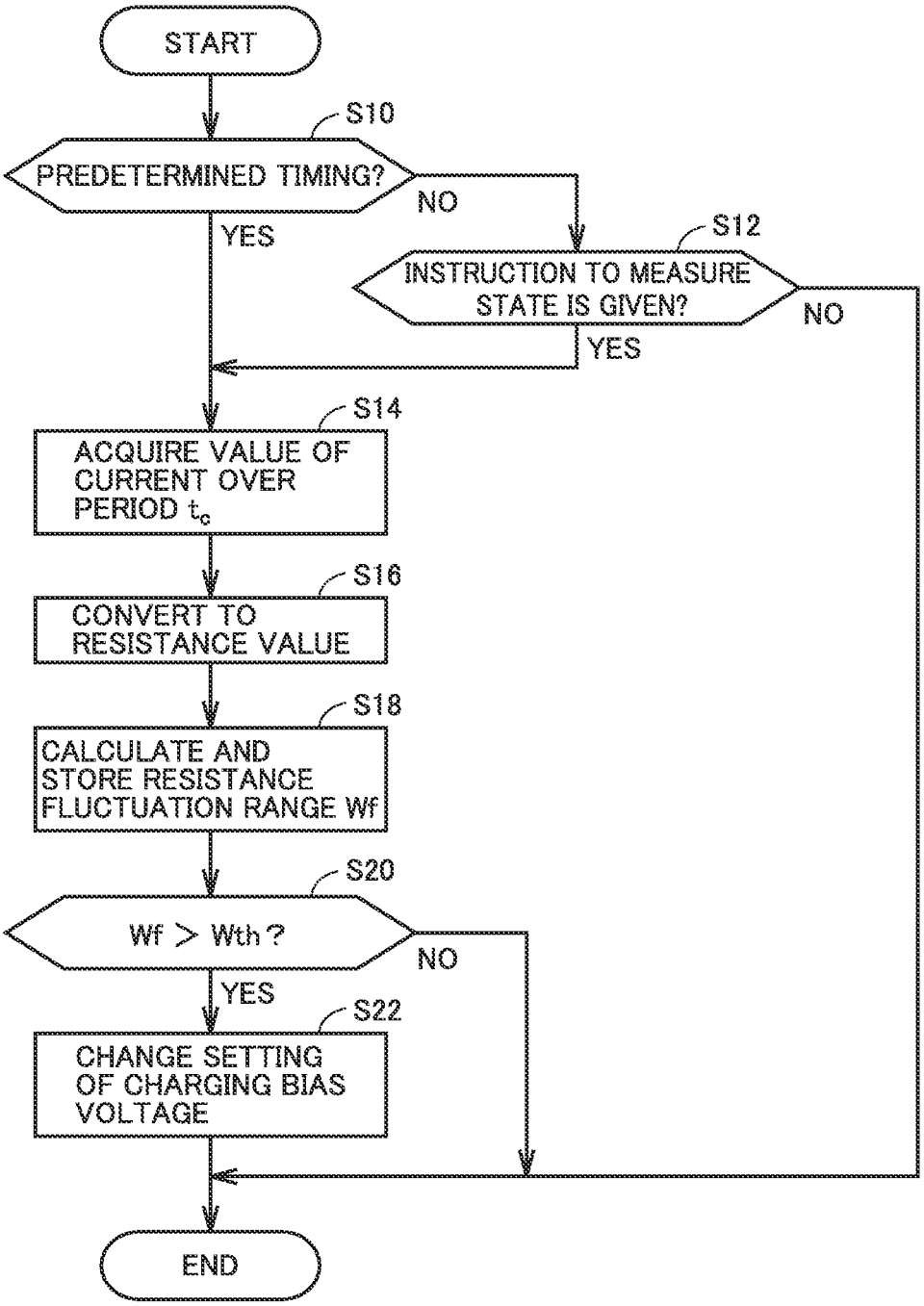
FIG. 8 is a flowchart illustrating a method for detecting a state of a crack and setting a charging bias voltage in accordance with the first embodiment.

Next, the above-described series of control operations will be described in connection with a flowchart shown in FIG. 8. FIG. 8 is a flowchart illustrating a method for detecting a state of a crack and setting a charging bias voltage in accordance with the first embodiment. The process shown in FIG. 8 is implemented through execution, by CPU 52 included in control unit 50, of control program 47 stored in storage device 46. In another aspect, a part or the whole of the process may be executed by hardware such as circuit element or the like. These conditions are similarly applied to other flowcharts described later herein.

Referring to FIG. 8, in step S10, control unit 50 determines whether or not it is a predetermined timing for detecting the state of charging roller 10Y. The predetermined timing may for example be a timing when image forming apparatus 100 is powered. In another aspect, the predetermined timing may be a timing when the cumulative number of revolutions of charging roller 10Y or photoconductor 3Y, the cumulative distance of travel thereof, the cumulative rotation period thereof, or the number of printed sheets of paper produced by means of imaging unit 2Y exceeds a predetermined value. In still another aspect, the predetermined timing may be a timing to perform image stabilization control (a timing when the temperature and/or humidity changes to exceed a predetermined value after the image forming apparatus is powered, for example). The predetermined timing may be any combination of the example timings described above.

When control unit 50 determines that it is a predetermined timing (YES in step S10), the process proceeds to step S14. In contrast, when control unit 50 determines that it is not a predetermined timing (NO in step S10), the process proceeds to step S12.

In step S12, control unit 50 determines whether or not an instruction to measure the state of charging roller 10Y is input. The instruction is input to control unit 50 through operation of display unit 44 which functions as a touch panel, by a serviceperson who conducts maintenance of image forming apparatus 100, for example. When control unit 50 determines that the instruction to measure the state is given (YES in step S12), the process proceeds to step S14. In contrast, when control unit 50 determines that the instruction to measure the state is not given (NO in step S12), the process ends.

In step S14, control unit 50 causes current acquisition unit 17 to acquire the value of current over period tc of one rotation of charging roller 10Y. Period tc is determined by the external diameter of charging roller 10Y and the surface speed of charging roller 10Y and supposed to be stored in storage device 46.

If the surface speed of charging roller 10Y is excessively high, the value of current acquired by current acquisition unit 17 is averaged and the state of a crack generated in charging roller 10Y cannot accurately be detected. Therefore, control unit 50 performs control for making the surface speed of charging roller 10Y, namely the surface speed of photoconductor 3Y, slower than the surface speed during normal printing, in the time interval in which current acquisition unit 17 acquired the value of current. By way of example, control unit 50 controls the surface speed of charging roller 10Y so that the surface speed is 100 mm/sec or less. Accordingly, control unit 50 can accurately detect the state of a crack in charging roller 10Y.

In step S16, control unit 50 calculates the in-period resistance of charging roller 10Y, based on the value of current which is input from current acquisition unit 17. In step S18, control unit 50 calculates fluctuation range Wf by subtracting the minimum resistance value of the in-period resistance of charging roller 10Y from the maximum resistance value thereof, and stores fluctuation range Wf in storage device 46. In another aspect, control unit 50 may use an average resistance value in a predetermined time interval in which the fluctuation falls in a predetermined range of fluctuation, instead of the minimum resistance value. In this way, even when the resistance locally decreases in a region due to a certain factor, control unit 50 can ignore this region and calculate the fluctuation range.

In step S20, control unit 50 determines whether or not the calculated fluctuation range Wf is larger than threshold value Wth to thereby determine whether or not a crack is generated in charging roller 10Y to the extent that causes an image defect. Threshold value Wth is supposed to be 250Ω by way of example. Threshold value Wth is stored in storage device 46.

When control unit 50 determines that fluctuation range Wf is larger than threshold value Wth (YES in step S20), control unit 50 changes setting of the charging bias voltage in step S22. More specifically, control unit 50 sets the charging bias voltage so that the charging bias voltage increases with increase of fluctuation range Wf. In contrast, when fluctuation range Wf is not larger than threshold value Wth (NO in step S20), control unit 50 ends the process.

As seen from the foregoing, image forming apparatus 100 in accordance with the first embodiment can detect the state of a crack generated in the charging roller, based on fluctuation range Wf which is calculated from the in-period resistance of the charging roller. In addition, the image forming apparatus in accordance with the first embodiment can apply an appropriate charging bias voltage depending on the state of a crack to thereby suppress an image defect due to the crack and extend the lifetime of the imaging unit.

In the above-described example, current acquisition unit 17 is configured to acquire the value of current over period tc of one rotation of charging roller 10Y. However, this is not a limitation. Control unit 50 may at least be configured to calculate the value of resistance of the charging roller over a predetermined time interval (the time interval taken for charging roller 10Y to make a half rotation, for example) in the state where charging roller 10Y is rotating. In this case as well, the image forming apparatus can detect the state of a crack generated in at least a part of charging roller 10Y.

Moreover, in the above-described example, the value of resistance of charging roller 10Y is calculated based on the value of current which flows when a constant voltage is applied to charging roller 10Y. However, this is not a limitation. In another aspect, the value of resistance of charging roller 10Y may be calculated by measuring the value of voltage which is applied when constant current is caused to flow from power supply device 16 to charging roller 10Y.

Moreover, while control unit 50 is configured to calculate, in step S16, the value of resistance of charging roller 10Y based on the value of current, this step S16 may be skipped in another aspect. Namely, control unit 50 may be configured to detect the state of a crack, based on the fluctuation range of the value of current acquired by current acquisition unit 17 (namely the value of current flowing in charging roller 10Y). In this case, control unit 50 can skip the step of converting the value of current to the value of resistance, and therefore, the state of a crack can more quickly be detected.

C. Second Embodiment—Control Based on Fluctuation Corresponding to Period of Charging Roller The image forming apparatus in accordance with the first embodiment is configured to acquire the value of resistance of charging roller 10Y over period tc of one rotation of charging roller 10Y to calculate fluctuation range Wf from the maximum resistance value and the minimum resistance value. However, because charging roller 10Y is disposed in contact with photoconductor 3Y, fluctuation of the value of current due to the non-uniformity (adhesion of dirt for example) of the surface state of photoconductor 3Y is also detected. In this case, even when no crack is generated in charging roller 10Y, control unit 50 may erroneously detect that a crack is generated to the extent that causes an image defect. In view of this, the image forming apparatus in accordance with a second embodiment calculates fluctuation range Wf based on peaks detected in period tc in order to avoid such erroneous detection. The basic configuration of the image forming apparatus in accordance with the second embodiment is identical to that of the image forming apparatus in accordance with the first embodiment, and therefore, the description thereof will not be repeated.

Figure 9:
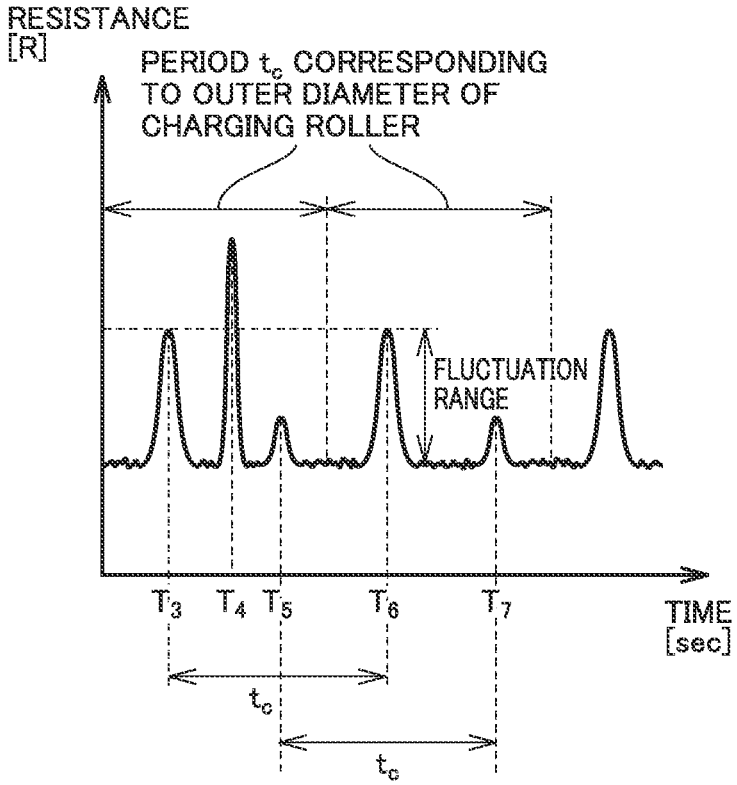
FIG. 9 is a diagram illustrating a method for calculating a fluctuation range in accordance with a second embodiment.

FIG. 9 is a diagram illustrating a method for calculating fluctuation range Wf in accordance with the second embodiment. Control unit 50 in accordance with the first embodiment is configured to acquire the resistance per at least one rotation of charging roller 10Y. In contrast, current acquisition unit 17 in accordance with the second embodiment is configured to acquire the resistance per at least two rotations of charging roller 10Y.

Referring to FIG. 9, the calculated value of resistance of charging roller 10Y has peaks at time T3 to T7. Among these peaks, the peaks observed at time T3 and T6 have respective resistance values substantially identical to each other and the interval between time T3 and T6 is substantially equal to period tc. In addition, the relation between the peaks observed at time T5 and T7 is similar to the relation between the peaks at time T3 and T6. Then, the peaks observed at time T3, T6 and time the peaks observed at time T5, T7 are regarded as being due to a crack of charging roller 10Y.

In contrast, the peak observed at time T4 is regarded as not being due to the crack of charging roller 10Y, since a similar peak is not observed after period tc from time T4.

Control unit 50 in accordance with the second embodiment makes use of the above characteristic to only extract peaks of the calculated resistance value which are generated due to a crack of charging roller 10Y. Subsequently, based on the extracted peaks, control unit 50 calculates fluctuation range Wf. Image forming apparatus 100 in accordance with the second embodiment configured in the above-described manner can calculate fluctuation range Wf based on fluctuation of the resistance due to a crack of charging roller 10Y and therefore can more accurately detect the state of the crack.

Figure 10:
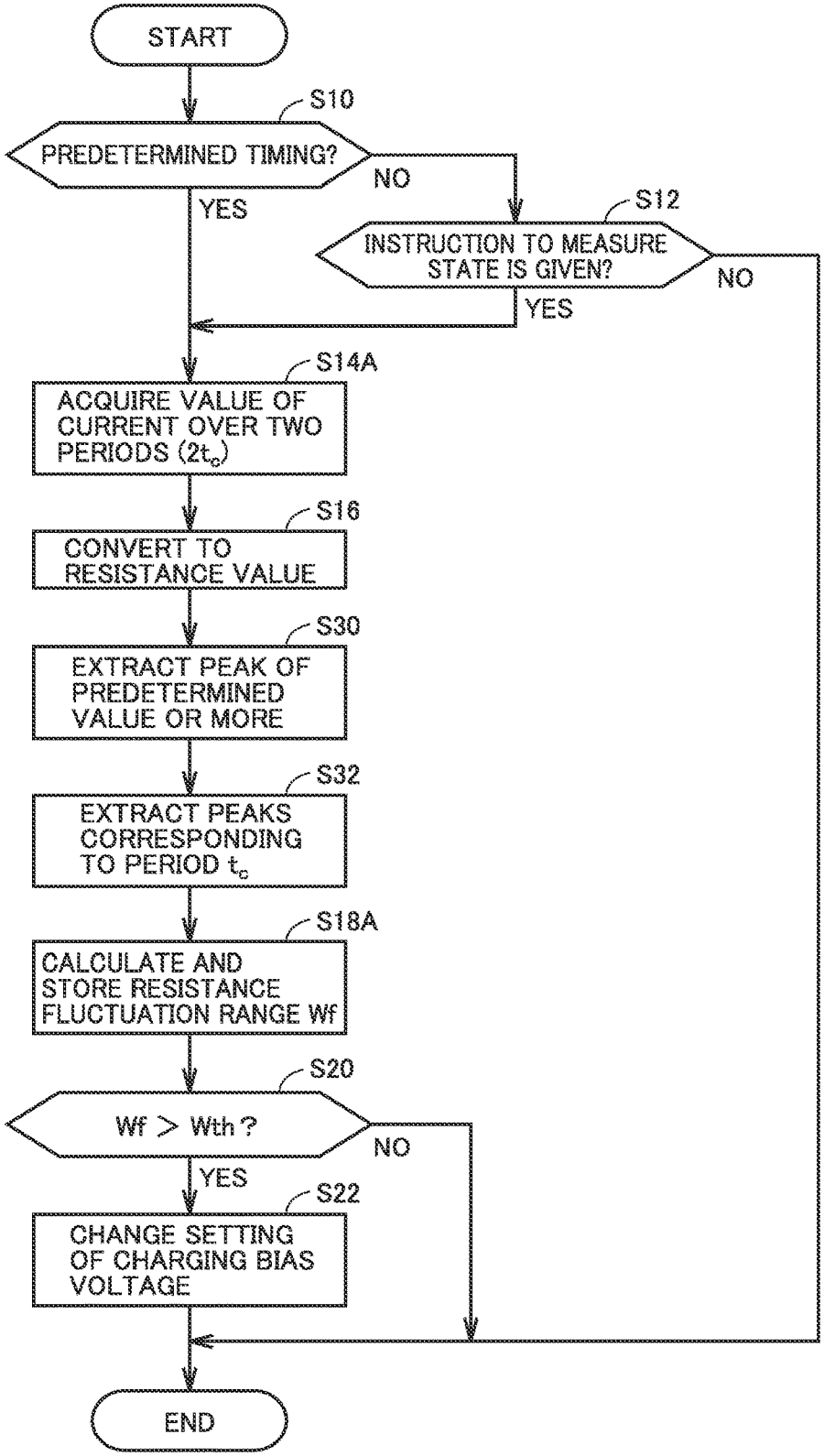
FIG. 10 is a flowchart illustrating detection of a state of a crack in accordance with the second embodiment.

FIG. 10 is a flowchart illustrating detection of a state of a crack in accordance with the second embodiment. Any step in FIG. 10 indicated by the same reference character as the one in FIG. 8 is the same as the corresponding step in FIG. 8, and therefore the description thereof will not be repeated.

Referring to FIG. 10, in step S14A, control unit 50 causes current acquisition unit 17 to acquire the value of current over a time interval taken for charging roller 10Y to make two rotations.

In step S30, based on the calculated value of resistance, control unit 50 extracts peaks having a predetermined value of resistance or more. In this way, control unit 50 can exclude minute peaks irrelevant to the subsequent steps.

In step S32, control unit 50 further extracts, from the extracted peaks, peaks corresponding to period tc. In another aspect, control unit 50 may be configured to extract, from the extracted peaks, peaks corresponding to period tc and having substantially identical resistance values. Control unit 50 configured in this manner can more accurately detect the state of the crack.

In step S18A, control unit 50 calculates fluctuation range Wf by subtracting the minimum resistance value of the calculated resistance values, from the maximum peak value among the values of peaks corresponding to period tc.

As seen from the foregoing, image forming apparatus 100 in accordance with the second embodiment can calculate fluctuation range Wf based on fluctuation of the resistance due to a crack of charging roller 10Y and therefore can more accurately detect the state of the crack.

D. Third Embodiment—Conversion of Value of Fluctuation Range Depending on Environment Fluctuation range Wf as described above has a characteristic that it varies depending on the environment around charging roller 10Y, particularly the temperature and the humidity. In view of this, an image forming apparatus 100A in accordance with a third embodiment measures the temperature and the humidity around charging roller 10Y and corrects fluctuation range Wf based on the temperature and the humidity to thereby more accurately detect the state of a crack generated in charging roller 10Y.

d1. Image Forming Apparatus 100A

Figure 11:
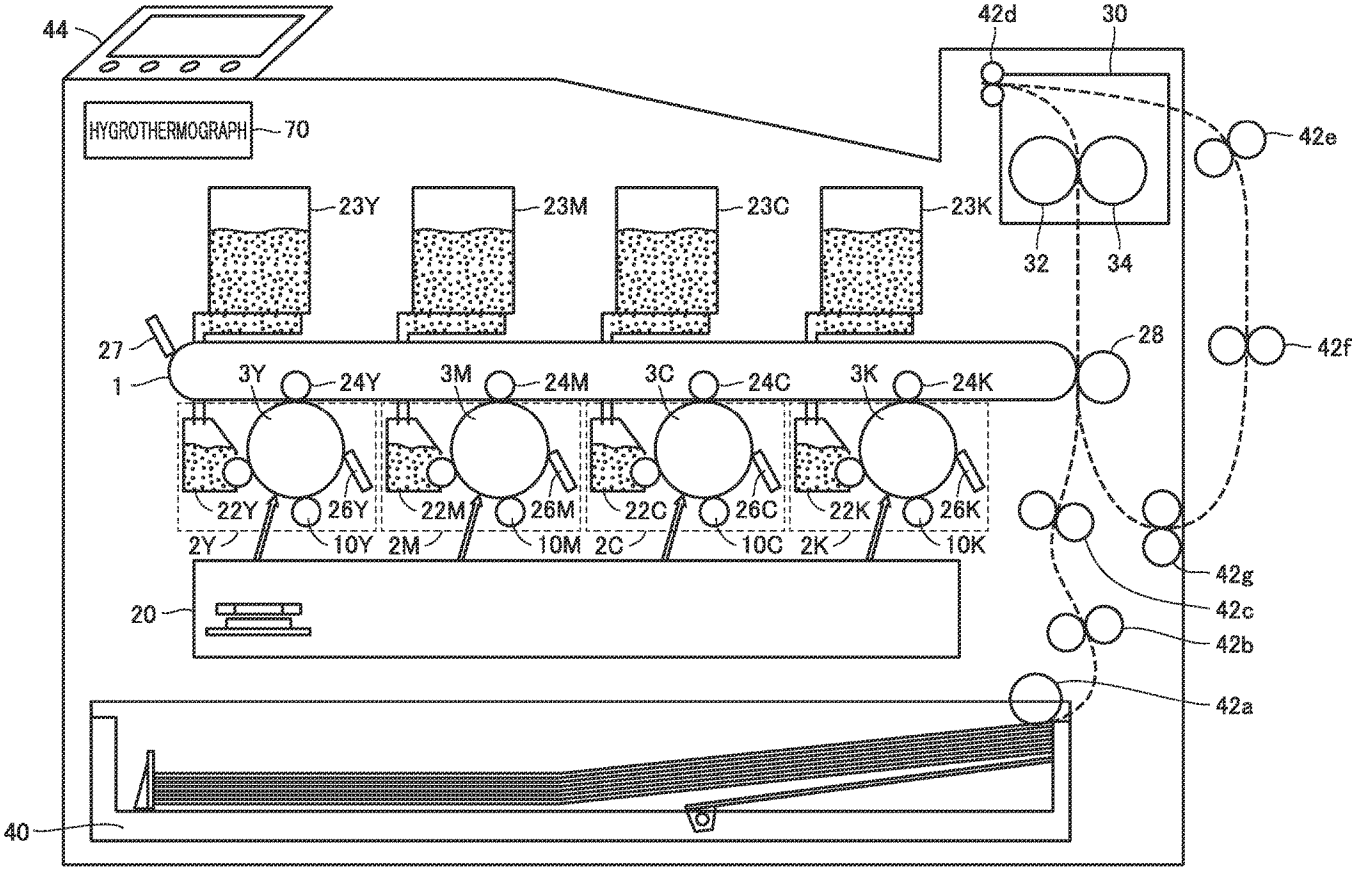
FIG. 11 is a diagram illustrating an example configuration of an image forming apparatus in accordance with a third embodiment.

FIG. 11 is a diagram illustrating an example configuration of an image forming apparatus in accordance with the third embodiment. Any part in FIG. 11 indicated by the same reference character as the one in FIG. 2 is the same as the corresponding part in FIG. 2, and therefore the description thereof will not be repeated. Relative to image forming apparatus 100 in accordance with the first embodiment, image forming apparatus 100A additionally includes a hygrothermograph 70. Hygrothermograph 70 is electrically connected to control unit 50 and configured to output measured temperature and humidity to control unit 50.

d2. Relation Between Fluctuation Range and Temperature and Humidity

Figure 12:
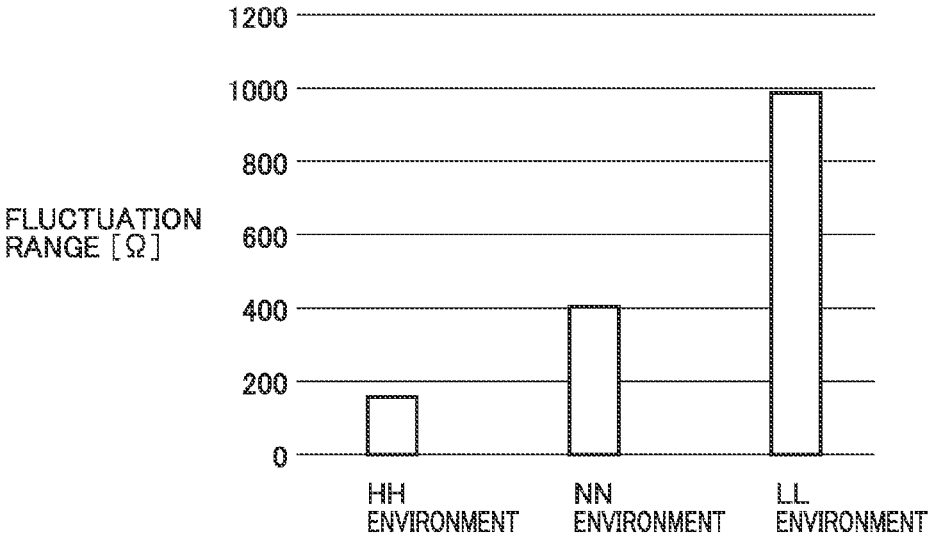
FIG. 12 is a diagram illustrating a relation between a fluctuation range and temperature and humidity.

FIG. 12 is a diagram illustrating a relation between fluctuation range Wf and the temperature and humidity. In an environment with a temperature of 23° C. and a relative humidity of 65% (hereinafter also referred to as "NN environment"), fluctuation range Wf of a charging roller was calculated, and the calculated fluctuation range Wf was approximately 400Ω.

In an environment with a temperature of 15° C. and a relative humidity of 10% (hereinafter also referred to as "LL environment"), fluctuation range Wf of the same charging roller as described above was calculated, and the calculated fluctuation range Wf was about 2.6 times as large as the fluctuation range in the NN environment. This is for the reason that the charging roller is more easily charged as the temperature is lower and the humidity is lower. In contrast, in an environment with a temperature of 30° C. and a relative humidity of 80% (hereinafter also referred to as "HH environment"), fluctuation range Wf of the same charging roller as described above was calculated, and the calculated fluctuation range Wf was about 0.4 times as large as the fluctuation range in the NN environment.

d3. Correction Based on Temperature and Humidity

As described above, fluctuation range Wf varies depending on the temperature and the humidity. Therefore, control unit 50 in accordance with the third embodiment corrects the value which is determined by subtracting the minimum resistance value from the maximum resistance value of the in-period resistance (the determined value is hereinafter also referred to as "resistance variation"), based on the result of measurement of hygrothermograph 70, and uses the corrected value as fluctuation range Wf for the subsequent control. By way of example, control unit 50 converts the resistance variation to a value detected in the NN environment. In this case, control unit 50 multiplies the resistance variation calculated in the HH environment by 2.5 (=1/0.4) and uses the calculated product as fluctuation range Wf. The correction factor is a value which depends on the materials for charging roller 10Y and photoconductor 3Y or the like, and preferably values measured in advance or a relational expression derived from the measured values are stored in storage device 46.

Figure 13:
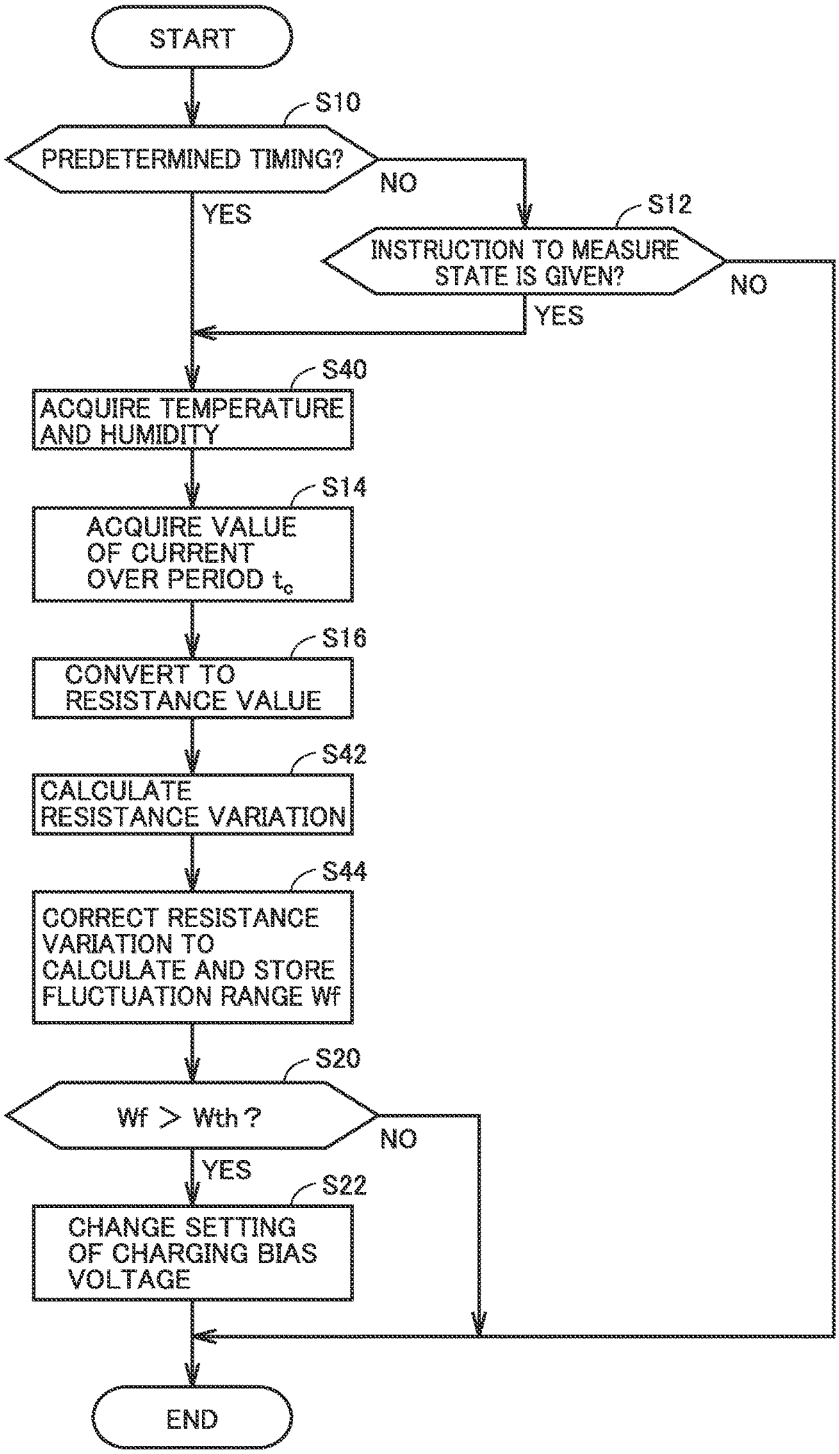
FIG. 13 is a flowchart illustrating detection of a state of a crack in accordance with the third embodiment.

FIG. 13 is a flowchart illustrating detection of a state of a crack in accordance with the third embodiment. Any step in FIG. 13 indicated by the same reference character as the one in FIG. 8 is the same as the corresponding step in FIG. 8, and therefore the description thereof will not be repeated.

In step S40, control unit 50 acquires a temperature and a relative humidity from hygrothermograph 70. In step S42, control unit 50 calculates the resistance variation from the in-period resistance.

In step S44, control unit 50 corrects the calculated resistance variation based on the acquired temperature and humidity to thereby calculate fluctuation range Wf.

As seen from the foregoing, image forming apparatus 100A in accordance with the third embodiment can correctly detect the state of a crack generated in charging roller 10Y, regardless of variation of the temperature and the humidity around charging roller 10Y.

In the above example, image forming apparatus 100A is configured to correct the resistance variation using both the temperature and the humidity. In another aspect, image forming apparatus 100A may be configured to correct the resistance variation based on information about any one of the temperature and the humidity to thereby calculate the fluctuation range.

E. Fourth Embodiment—Prediction of Lifetime

As described above, fluctuation range Wf increases with use of charging roller 10Y (imaging unit 2Y including charging roller 10Y). Using this characteristic, an image forming apparatus in accordance with a fourth embodiment predicts the timing when fluctuation range Wf reaches a level that causes an image defect, based on information about a plurality of fluctuation ranges Wf measured at different times. The basic configuration of the image forming apparatus in accordance with the fourth embodiment is identical to that of the image forming apparatus in accordance with the first embodiment, and therefore, only different characteristics will be described.

Figure 14:
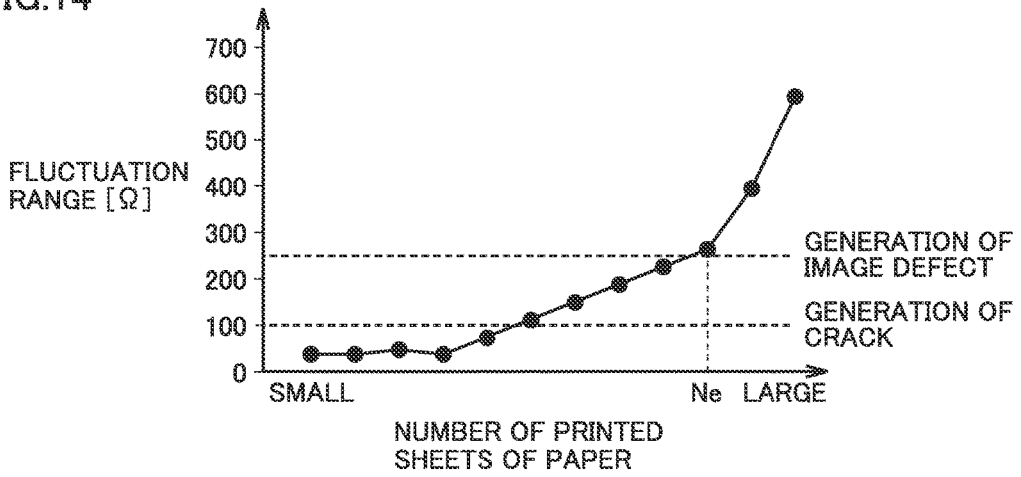
FIG. 14 is a diagram illustrating a relation between the number of sheets of paper printed by means of an imaging unit, and a fluctuation range.

FIG. 14 is a diagram illustrating a relation between the number of sheets of paper printed by means of imaging unit 2Y, and fluctuation range Wf. Referring to FIG. 14, in the initial state where the number of sheets of paper printed by means of imaging unit 2Y is small, no crack is generated in charging roller 10Y and therefore, fluctuation range Wf of the resistance is less than 100Ω. As described above in connection with FIG. 7, a small crack is generated between elastic layer 12 and protective layer 13 of charging roller 10Y when fluctuation range Wf exceeds 100Ω. Then, as the number of printed sheets of paper increases, fluctuation range Wf increases with growth of the crack. When fluctuation range Wf exceeds 250Ω, an image defect occurs.

Control unit 50 in accordance with the fourth embodiment calculates fluctuation range Wf at a predetermined timing such as power-on, and stores, in storage device 46, this fluctuation range Wf and the number of printed sheets of paper at the timing when the fluctuation range Wf is calculated. This fluctuation range Wf and the number of printed sheets are associated with each other in storage device 46. Control unit 50 uses two or more pieces of information (hereinafter also referred to as "history information") about fluctuation range Wf and the number of printed sheets of paper associated with each other to predict the number Ne of printed sheets of paper at the time when fluctuation range Wf reaches a predetermined value (250Ω for example) which causes an image defect, namely predict the lifetime of imaging unit 2Y.

In another aspect, in the case where charging roller 10Y is configured independently of imaging unit 2Y so that charging roller 10Y in image forming apparatus 100 can be replaced, control unit 50 predicts the lifetime of charging roller 10Y.

The time when a crack is generated in charging roller 10Y and the growth rate of the crack vary depending on manufacture variation of spring 15, elastic layer 12, and protective layer 13 for example and also depending on the environment in use of image forming apparatus 100. It has therefore been difficult to predict the lifetime of charging roller 10Y. However, image forming apparatus 100 in accordance with the fourth embodiment can accurately predict the lifetime of charging roller 10Y. In another aspect, control unit 50 may be configured to predict the number of printed sheets of paper at the time when a crack is generated in charging roller 10Y, based on the history information.

Control unit 50 may be configured to use a plurality of approximation formulas stored in storage device 46 and use an approximation formula with the highest determination coefficient, when it predicts the number Ne of printed sheets of paper.

Control unit 50 may also be configured to predict the number Ne of printed sheets of paper using only the history information (history information with fluctuation range Wf exceeding 100Ω for example) after generation of a crack in charging roller 10Y. In the state where no crack is generated in charging roller 10Y, the correlation between fluctuation range Wf and the number of printed sheets of paper is weak and therefore, use of such history information may deteriorate the accuracy with which the number Ne of printed sheets of paper is predicted. Therefore, control unit 50 can use only the history information after generation of a crack in charging roller 10Y to thereby increase the prediction accuracy of the number Ne of printed sheets of paper.

In the case where control unit 50 predicts the number Ne of printed sheets of paper based on the history information, control unit 50 indicates the result of prediction on display unit 44. Thus, a user or serviceperson of image forming apparatus 100 in accordance with the fourth embodiment can take measures in accordance with the result of prediction (prepare imaging unit 2Y for replacement for example).

Moreover, control unit 50 informs an external device (mobile communication terminal for example), which is used by a serviceperson, of the predicted number Ne of printed sheets of paper through communication interface 48. The serviceperson then takes measures appropriate for the number Ne of printed sheets of paper given from control unit 50. Accordingly, the serviceperson can remotely recognize the state of image forming apparatus 100. In another aspect, control unit 50 may be configured to inform the external device, when the number of printed sheets of paper reaches the number determined by subtracting a predetermined number of sheets (5000 sheets for example) from the predicted number Ne of printed sheets of paper, of this fact.

As seen from the foregoing, the image forming apparatus in accordance with the fourth embodiment can predict the lifetime of the charging roller based on the history information. Moreover, the image forming apparatus in accordance with the fourth embodiment informs a user or a serviceperson of the predicted lifetime. Therefore, the user or serviceperson can take measures appropriate for the lifetime. In particular, when an abnormal condition such as image defect occurs, conventionally the serviceperson often replaces the imaging unit including the charging roller in spite of the fact that the lifetime of the charging roller has not yet been reached. The image forming apparatus in accordance with the fourth embodiment can also solve such a problem, since the image forming apparatus informs the serviceperson of the lifetime of the charging roller.

In the above-described example, the history information is information in which fluctuation range Wf is associated with the number of printed sheets of paper. However, this is not a limitation. In another aspect, the history information may be information in which information about any one of the cumulative number of revolutions and the cumulative distance of travel of charging roller 10Y or photoconductor 3Y is associated with fluctuation range Wf. Accordingly, control unit 50 can accurately predict the lifetime of charging roller 10Y regardless of the size of the sheet of paper to be printed.

There can also be provided a program causing a computer to function and execute the control as described above in connection with the first to fourth embodiments. Such a program can also be recorded on a non-transitory computer-readable recording medium associated with a computer, such as flexible disk, CD-ROM (Compact Disk-Read Only Memory), ROM (Read Only Memory), RAM (Random Access Memory), and memory card, and provided as a program product. Alternatively, the program can also be provided by being recorded on a recording medium such as hard disk contained in a computer. Moreover, the program can also be provided by being downloaded through a network.

The above program may call required modules in a predetermined sequence and at predetermined timings from program modules provided as a part of an operating system (OS) of a computer and cause processing to be performed. In this case, the above-described modules are not included in the program itself, and processing is executed in cooperation with the OS. Such a program that does not include these modules may be included in the program in accordance with the present invention.

Moreover, the program in accordance with the present invention may be provided by being incorporated in a part of another program. In this case as well, the program itself does not include modules included another program as described above, and the program is treated in cooperation with another program. A program incorporated in the other program may also be included in the program in accordance with the present invention.

The program product to be provided is executed in the state of being installed in a program storage such as hard disk. The program product includes a program itself and a recording medium on which the program is recorded.

Although the embodiments of the present invention have been described, it should be construed that the embodiments disclosed herein are given by way of example in all respects, not by way of limitation. It is intended that the scope of the present invention is defined by claims and encompasses all modifications equivalent in meaning and scope to the claims.

What is claimed is:

1. An image forming apparatus comprising:

an image carrier configured to carry and transport a latent image;

a charging member configured to be rotatable and disposed in contact with a surface of the image carrier;

an acquisition device configured to acquire an electrical characteristic of the charging member; and a processor configured to calculate a range of fluctuation of the electrical characteristic associated with rotation of the charging member;

wherein the processor is configured to acquire the electrical characteristic over a time interval taken for the charging member to make at least one rotation, and calculate the range of fluctuation of the electrical characteristic in the time interval; and the processor is configured to determine whether the range of fluctuation exceeds a predetermined threshold value.

2. The image forming apparatus according to claim 1, wherein the processor is configured to perform a predetermined operation based on the calculated range of fluctuation.

3. The image forming apparatus according to claim 2, wherein the processor is configured to perform the predetermined operation when the range of fluctuation exceeds a predetermined threshold value.

4. The image forming apparatus according to claim 2, wherein the predetermined operation includes an operation of increasing a charging bias voltage to be applied to the image carrier through the charging member in printing, as the range of fluctuation increases.

5. The image forming apparatus according to claim 1, wherein the processor is configured to perform control to make a surface speed of the charging member slower than the surface speed of the charging member during printing, over a time interval in which the acquisition device acquires the electrical characteristic.

6. The image forming apparatus according to claim 1, further comprising a sensor configured to measure information about at least one of temperature and humidity, wherein the processor is configured to calculate the range of fluctuation converted in accordance with a result of measurement by the sensor.

7. The image forming apparatus according to claim 1, wherein the processor is configured to acquire the electrical characteristic over a time interval taken for the charging member to make at least two rotations, and calculate the range of fluctuation based on a peak of the electrical characteristic detected in a period corresponding to an external diameter of the charging member.

8. The image forming apparatus according to claim 1, wherein the electrical characteristic includes a value of current flowing in the charging member when a predetermined voltage is applied to the charging member.

9. The image forming apparatus according to claim 1, wherein the electrical characteristic includes a value of voltage generated at the charging member when a predetermined current is applied to the charging member.

10. The image forming apparatus according to claim 1, wherein the processor is configured to calculate the range of fluctuation at a predetermined timing.

11. An image forming apparatus comprising:

an image carrier configured to carry and transport a latent image;

a charging member configured to be rotatable and disposed in contact with a surface of the image carrier;

an acquisition device configured to acquire an electrical characteristic of the charging member; and a processor configured to calculate a range of fluctuation of the electrical characteristic associated with rotation of the charging member;

wherein the processor is configured to perform a predetermined operation based on the calculated range of fluctuation;

wherein the predetermined operation comprises an operation of predicting a lifetime of at least one of the charging member and a unit including the charging member, based on information about history of the range of fluctuation which is associated with at least one of:

information about a cumulative number of revolutions of the charging member;

information about a cumulative distance of travel of the charging member;

information about a cumulative rotation period of the charging member; and information about a cumulative number of printed sheets of paper obtained by using the charging member.

12. The image forming apparatus according to claim 11, further comprising an interface configured to allow communication with an external device, wherein the predetermined operation includes an operation of informing the external device, through the interface, of the predicted lifetime.

13. The image forming apparatus according to claim 11, further comprising an interface configured to allow communication with an external device, wherein the predetermined operation includes an operation of informing the external device, through the interface, of reaching the lifetime, when a predetermined condition based on the information about history of the range of fluctuation is satisfied.

14. The image forming apparatus according to claim 11, further comprising a display configured to present information to a user, wherein the predetermined operation includes an operation of indicating the predicted lifetime on the display.

15. The image forming apparatus according to claim 11, wherein the processor is configured to perform control to make a surface speed of the charging member slower than the surface speed of the charging member during printing, over a time interval in which the acquisition device acquires the electrical characteristic.

16. The image forming apparatus according to claim 11, further comprising a sensor configured to measure information about at least one of temperature and humidity, wherein the processor is configured to calculate the range of fluctuation converted in accordance with a result of measurement by the sensor.

17. The image forming apparatus according to claim 11, wherein the processor is configured to acquire the electrical characteristic over a time interval taken for the charging member to make at least two rotations, and calculate the range of fluctuation based on a peak of the electrical characteristic detected in a period corresponding to an external diameter of the charging member.

18. The image forming apparatus according to claim 11, wherein the electrical characteristic includes a value of current flowing in the charging member when a predetermined voltage is applied to the charging member.

19. The image forming apparatus according to claim 11, wherein the electrical characteristic includes a value of voltage generated at the charging member when a predetermined current is applied to the charging member.

20. The image forming apparatus according to claim 11, wherein the processor is configured to calculate the range of fluctuation at a predetermined timing.

21. A method for controlling an image forming apparatus including a charging member disposed in contact with a surface of an image carrier and configured to be rotatable, the method comprising:

acquiring an electrical characteristic of the charging member over a predetermined time interval in which the charging member rotates; and calculating a range of fluctuation of the acquired electrical characteristic;

acquiring the electrical characteristic over a time interval taken for the charging member to make at least one rotation, and calculating the range of fluctuation of the electrical characteristic in the time interval; and determining whether the range of fluctuation exceeds a predetermined threshold value.

22. A non-transitory computer-readable recording medium storing a control program for an image forming apparatus including a charging member disposed in contact with a surface of an image carrier and configured to be rotatable, the control program causing a computer to execute a process comprising:

acquiring an electrical characteristic of the charging member over a predetermined time interval in which the charging member rotates; and calculating a range of fluctuation of the acquired electrical characteristic;

performing a predetermined operation based on the calculated range of fluctuation;

wherein the predetermined operation comprises an operation of predicting a lifetime of at least one of the charging member and a unit including the charging member, based on information about history of the range of fluctuation which is associated with at least one of:

information about a cumulative number of revolutions of the charging member;

information about a cumulative distance of travel of the charging member;

information about a cumulative rotation period of the charging member; and information about a cumulative number of printed sheets of paper obtained by using the charging member.

23. A method for controlling an image forming apparatus including a charging member disposed in contact with a surface of an image carrier and configured to be rotatable, the method comprising:

acquiring an electrical characteristic of the charging member over a predetermined time interval in which the charging member rotates; and calculating a range of fluctuation of the acquired electrical characteristic;

performing a predetermined operation based on the calculated range of fluctuation;

wherein the predetermined operation comprises an operation of predicting a lifetime of at least one of the charging member and a unit including the charging member, based on information about history of the range of fluctuation which is associated with at least one of:

information about a cumulative number of revolutions of the charging member;

information about a cumulative distance of travel of the charging member;

information about a cumulative rotation period of the charging member; and information about a cumulative number of printed sheets of paper obtained by using the charging member.

* * * * *